United States Patent [19]

Smith

[11] 4,222,528

[45] * Sep. 16, 1980

[54] MILL

[76] Inventor: Arthur Smith, 1845 Randolph St., Los Angeles, Calif. 90001

[ * ] Notice: The portion of the term of this patent subsequent to Feb. 27, 1996, has been disclaimed.

[21] Appl. No.: 968,740

[22] Filed: Dec. 13, 1978

Related U.S. Application Data

[63] Continuation-in-part of Ser. No. 806,724, Jun. 15, 1977, Pat. No. 4,141,510.

[51] Int. Cl.[3] ..... B02C 13/28

[52] U.S. Cl. ..... 241/46.02; 241/46.08; 241/238; 241/185 A

[58] Field of Search ..... 241/100.5, 46 R, 46 A, 241/46 B, 46.08, 46.11, 46.17, 46.02, 205, 238, 259.1, 277, 259.2, 260.1, 259.3, 121, 185 R, 185 A

[56] References Cited

U.S. PATENT DOCUMENTS

| | | | |
|---|---|---|---|
| 3,128,051 | 4/1964 | Smith | 241/46.11 |
| 3,726,486 | 4/1973 | Smith et al. | 241/46.11 |

*Primary Examiner*—Mark Rosenbaum

*Attorney, Agent, or Firm*—Georges A. Maxwell

[57] ABSTRACT

A mill comprising a case with a longitudinal flow passage; an annular milling ring with a plurality of circumferentially spaced radially inwardly projecting teeth fixed in the flow passage; a substantially disc-shaped rotor arranged centrally within the ring in free running clearance with the teeth, a prime mover to rotate the rotor; said rotor has a plurality of circumferentially spaced, straight, radially outwardly opening guideways; a plurality of milling blocks with elongate shanks slidably engaged in the guideways and milling heads normally projecting radially from the rotor into close running clearance with the teeth and movable radially inwardly relative to the teeth; and stop means to limit radial outward shifting and allow for free radial inward shifting of the blocks relative to the rotor.

16 Claims, 6 Drawing Figures

MILL

This application is a continuation in part of my copending application Ser. No. 806,724, filed June 15, 1977, now U.S. Pat. No. 4,141,510, issued Feb. 27, 1979, for MATERIAL REDUCTION MEANS FOR PUMPS.

This invention has to do with mills and is particularly concerned with a novel non-fouling mill structure.

The present invention has to do with that class of mill which comprises an annular stationary milling ring with a plurality of elongate, axially extending, circumferentially spaced radially inwardly projecting milling teeth, and a radially extending disc-shaped rotor arranged concentric and freely within the ring and having a plurality of circumferentially spaced radially extending milling blocks with outer axially extending edges in close running clearance with the teeth. The ring is fixed within a fluid or material conducting structure and the rotor is suitably supported on and rotated by the drive shaft of a suitable prime mover related to the structure.

Prior art mills of the general class of mills noted above are commonly used to reduce solid particulate material and/or fibrous material carried by a fluid medium, such as water. The solids and fluids constitute a slurry which is gravity fed or advanced through the mills by suitable pumping means.

As a rule, the radial extent and circumferential spacing of the teeth of the rings of such mills act as screens or classifying means and determine the maximum size of solids that can advance through the mills, that is, the size of solids that can advance freely through the circumferentially spaced, axially extending flow passages which are defined by the teeth and the rotors. Solids, be they fibrous or particulate in nature, which are so large and/or so disposed, when advanced into the rings, that they cannot or do not totally enter the flow passages, are engaged by advancing blocks on the rotors and are crushed, broken, shredded or otherwise reduced by and between the teeth and the blocks. Solids are worked upon in the above manner one or more times until they are reduced to a size which allows for their free entry into and movement through the flow passages.

While prior art mills of the character referred to above are considered quite effective in operation, their use is generally limited to situations or circumstances where the solids to be worked upon are structurally weak, quite frangible or otherwise such that they can be easily reduced. They are not dependable in situations where large particles of structurally strong material, not easily reduced, are likely to be encountered. For example, such mills are satisfactory for reducing most solids commonly conducted into and through domestic sewer systems and the like and have proven to be effective to reduce soft coal and to effect the transportation of such coal in aqueous slurries. Such mills are not satisfactory in waste disposal systems where metallic objects such as nails, screw fasteners and the like are likely to be encountered or where large pieces of hard, structurally sound materials such as rocks and bone are likely to be encountered.

In those situations where hard, strong, not readily reducible solid materials are encountered, pieces of those materials, when engaged between the teeth and blocks of the mills, frequently stop the rotors and put the mills out of operation, until the interfering materials are manually removed from engagement in the mills. To remove such interfering or fouling materials from such mills is often a difficult, time-consuming and costly operation.

It is understood that in the prior art, mills of the class here concerned with have been provided with reversible prime movers for the rotors so that if and when the rotors are stopped by a piece of hard material lodged between the teeth and blocks, the rotors can be turned in a reverse direction to move the blocks back and/or away from the interfering material and thereby allow those materials to drop or otherwise move out of interfering position in the mills. Thereafter, the rotors are again rotated in their normal direction of rotation and operation of the mills is continued.

While such reverse rotation of the rotors is oftentimes effective, it is just as often ineffective. It is not effective in those cases where the interfering or fouling materials become wedged or otherwise lodged between the teeth and blocks within the mills in such a manner as to jam the rotors in stopped position (not merely stop them).

An object of my invention is to provide an improved mill structure of the general class here concerned with which is such that it will not or is materially less likely to become jammed and fouled by non-reduced materials than are mills of similar class provided by the prior art.

It is an object and feature of the present invention to provide a mill structure of the character referred to above wherein the milling blocks are movably carried by the rotor whereby said blocks can be displaced substantially radially inward relative to the rotor and to the ring and therefore relative to unreduced solid materials engaged and stopped by the teeth of the mill.

It is another object and feature of the present invention to provide a mill of the character referred to wherein the blocks are elongate parts slidably engaged in elongate guideways in the rotor and have stop means related thereto which limit radial outward movement of the blocks to normally set their outer ends in predetermined spaced relationship with the teeth on the ring.

Another object and feature of my invention is to provide a mill of the character referred to wherein the blocks and their related guideways are sufficiently large in cross-section and in longitudinal extent to assure substantially free longitudinal shifting of the blocks in the guideways and to prevent such relative misalignment thereof as might cause binding of the blocks in the guideways and the prevention of longitudinal shifting of said blocks.

It is a further object and feature of this invention to arrange the blocks and guideways on axes angularly related to the radial planes of the rotor so that the inner portions of the blocks and the guideways therefor are spaced radially outward from the central axis of the rotor whereby the blocks and guideways can be substantially greater in longitudinal extent than the radial extent of the rotor.

Still another object of my invention is to provide a mill of the character referred wherein the blocks are normally urged and retained in their outermost position radially of the rotor by centrifugal force and are of sufficient mass to remain in that position during normal anticipated operation of the mill structure.

A further object of the invention is to dispose the blocks relative to the axis and normal direction of rotation of the rotor so that the blocks will readily shift inwardly and away from the ring when their outer ends engage and are stopped by an object or material supported and stopped on teeth of the mill ring.

Yet another object and feature of the present invention is to provide a mill of the character referred to above wherein the rotor is driven by a reversible prime mover and said prime mover is operated to reverse the direction of rotation of the rotor when the rotor is stopped by an object caught between a block and a tooth of the mill structure.

It is an object and feature of the invention to provide a mill of the character referred to wherein the blocks are shaped and are disposed relative to the rotor and to the teeth of the mill so that upon reverse rotation of the rotor, the blocks will readily disengage objects or materials stopped and supported by the teeth and will, upon engaging such material, move that material from engagement with the teeth and/or shift inwardly and ride over such material.

It is an object and feature of the present invention to provide a mill of the character referred to which is such that when objects or material are stopped by the teeth of the ring in interfering relationship with the blocks on the rotor and are not reduced by impacting engagement of the blocks therewith, the blocks, upon engaging the objects, can move radially inwardly to ride over the objects, whereby the objects are subjected to repeated impacting engagement of blocks thereupon until they are reduced or moved from interfering relationship therewith.

The foregoing and other objects and features of my invention will be fully understood from the following detailed description of a typical preferred form and embodiment of the invention, throughout which description reference is made to the accompanying drawings in which.

Figure 1:
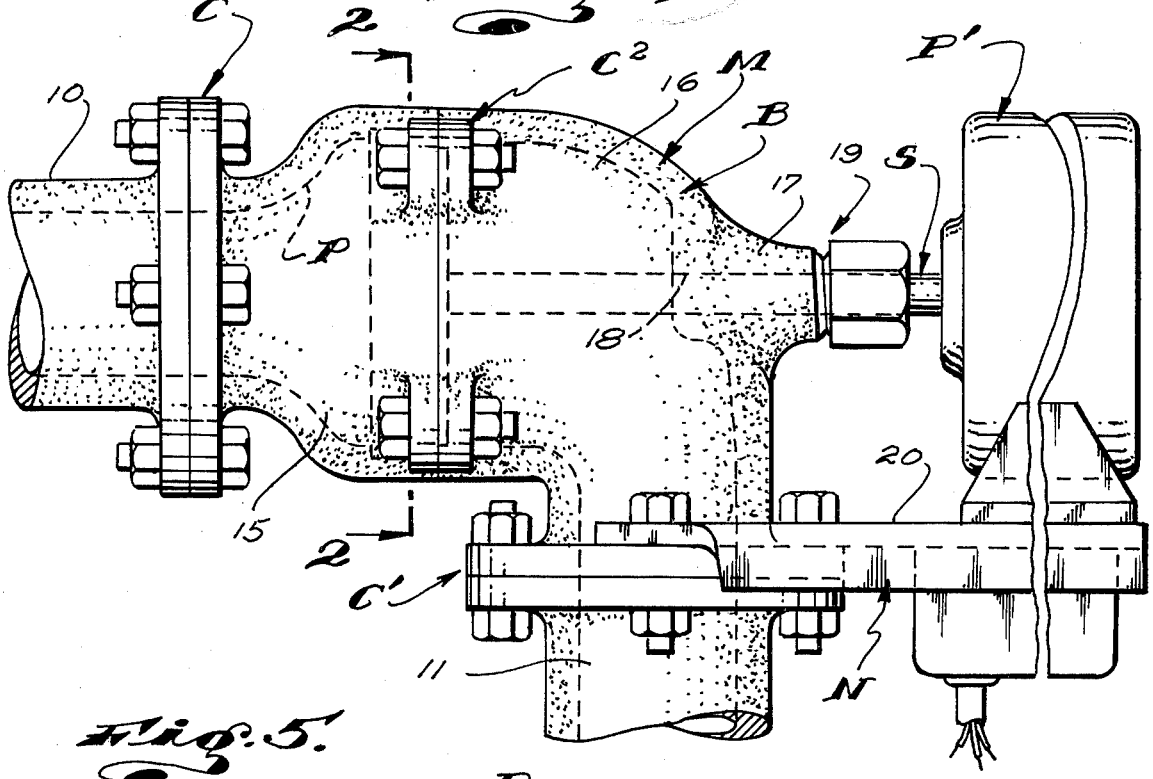
FIG. 1 is an elevationsl view of a mill embodying my invention.
Figure 5:
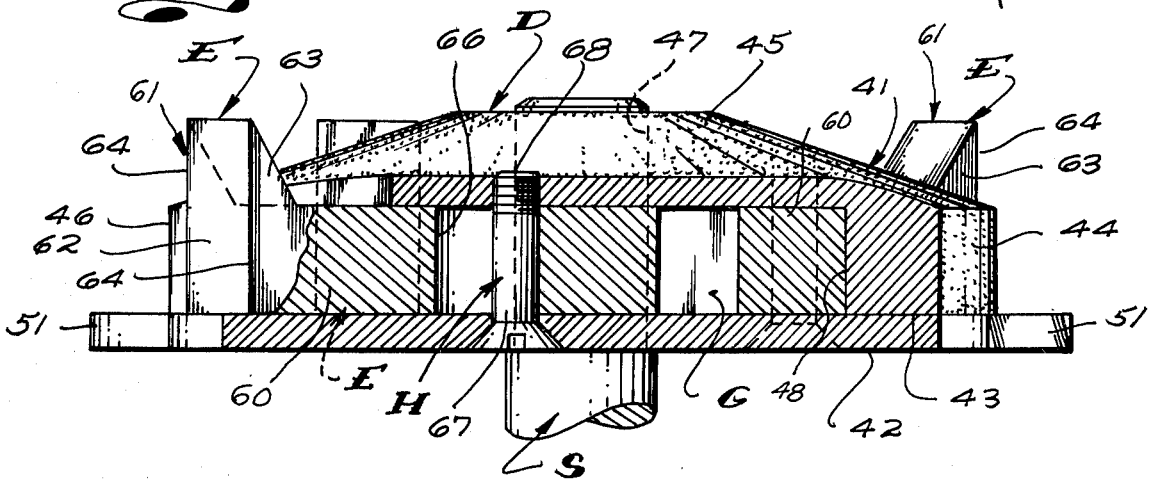
FIG. 5 is an enlarged detailed sectional view taken as indicated by line 5—5 on FIG. 4.

Referring to FIG. 1 of the drawings, the mill M that I provide is shown coupled with and between the outlet end of an upstream pipe section or supply pipe 10 and the inlet end of a downstream pipe section or delivery pipe 11.

The mill M includes the sectional, substantially L-shaped fluid conducting case B of cast steel or the like. The case B has an axially straight, forward or upstream section 15 with a central longitudinal passage P and an L-shaped rear or downstream section 16 through which the passage P is extended or continues. The forward or upstream end of the section 15 is connected with the pipe 10 by coupling means C and the downstream end of the rear section 16 is connected with the pipe 11 by coupling means C'. The coupling means C and C' can vary widely in form and in the case illustrated are conventional flange-type coupling means comprising radially outwardly projecting flanges on related parts and screw fastening means engaged through and holding the flanges in aligned fluid tight clamped engagement with each other.

The opposing rear and front or downstream and upstream ends of the case sections 15 and 16 are releasably secured together by coupling means $C^2$. The means $C^2$ can be similar to the means C and C', or can, as shown, include registering, circumferentially spaced radially outwardly projecting apertured tabs on the sections and screw fastening means engaged through adjacent related tabs and holding the sections tightly together.

The radially turned rearwardly disposed portion of the case section 16 is provided with a rearwardly projecting substantially cylindrical projection or neck 17 having a central shaft receiving opening 18. The neck 17 and opening 18 are concentric with the case section 15.

The outer free end of the neck 17 is provided with a suitable stuffing gland structure 19 to seal with the shaft S extending through the neck. The stuffing gland structure can vary widely in details of construction and can, if desired, be replaced by any suitable sealing means, such as a sealing means utilizing O-ring seals and the like, without departing from the spirit of my invention.

Finally, the case section 16 can, if necessary or desired, be provided with motor mounting means N to facilitate mounting a prime mover such as an electric motor P', downstream or rearward of the section 16, in axial alignment with the neck 17.

For the purposes of illustration, the means N is shown as including a motor mounting plate 20 suitably related to and releasably secured in place by the coupling means C', substantially as shown in FIG. 1 of the drawings.

The prime mover or motor P' is secured to the plate 20 by appropriate fastening means (not shown) with its output shaft S in axial alignment with the neck 17. The shaft S projects axially forwardly from the motor P', through the stuffing gland 19, opening 18 in the neck 17 and freely into and through the upstream portion of the case section 16 and into the downstream portion of the case section 15.

It will be apparent that the means N, illustrated and described above, can be varied widely in practice without in any way departing from or affecting the novelty of the present invention.

Figure 2:
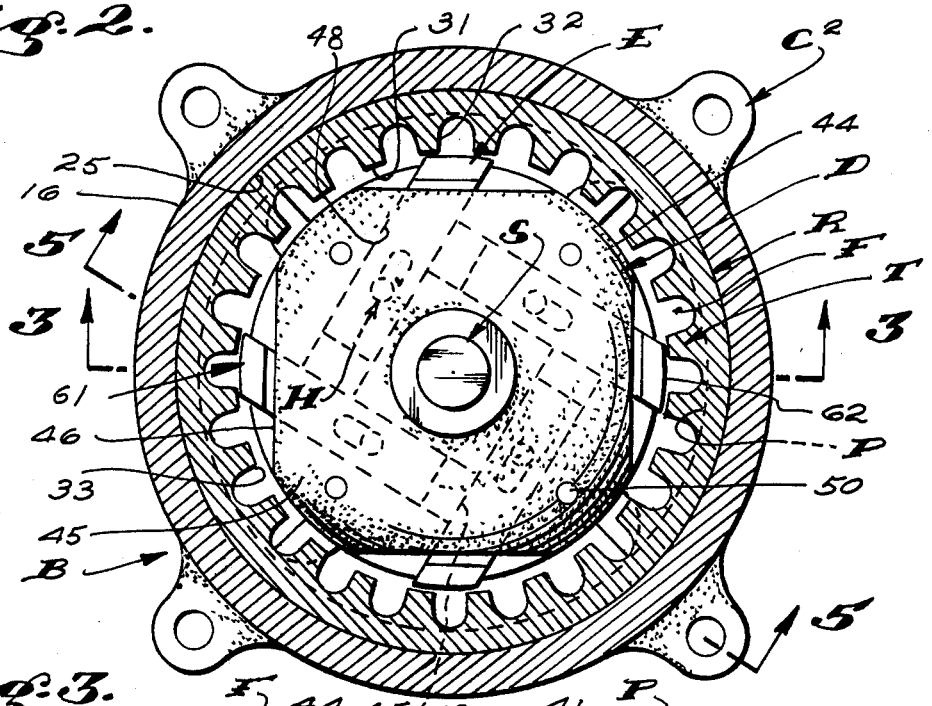
FIG. 2 is an enlarged detailed sectional view taken as indicated by line 2—2 on FIG. 1.
Figure 4:
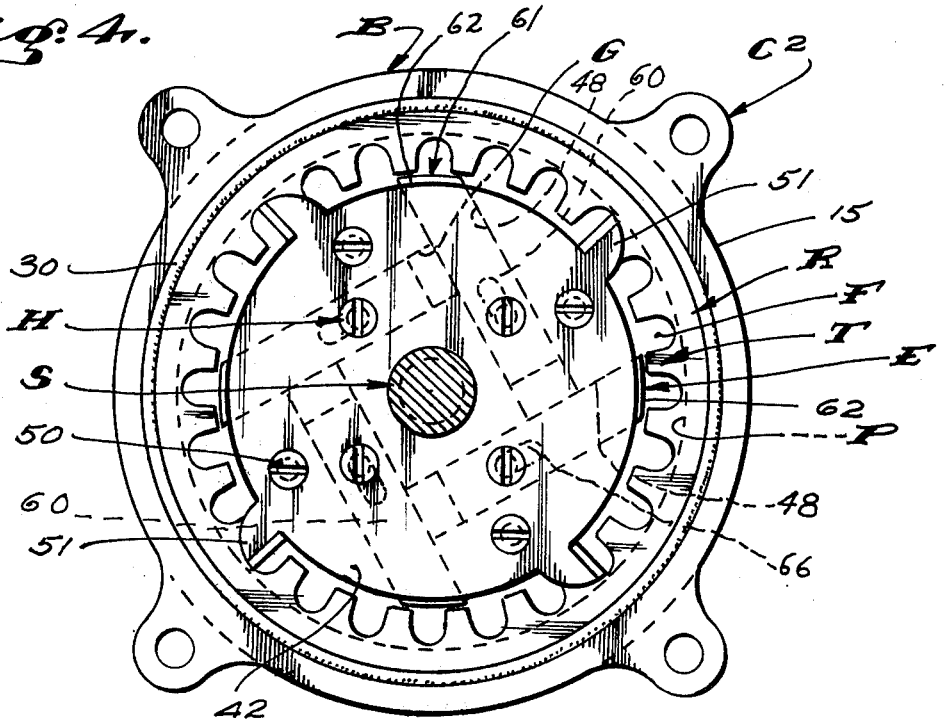
FIG. 4 is a sectional view taken as indicated by line 4—4 on FIG. 3.

Referring to FIGS. 2 and 4 of the drawings, the mill M that I provide next includes an elongate axially extending annular milling ring R arranged concentric within the upstream portion of the passage P in the case B concentric with the shaft S.

Figure 3:
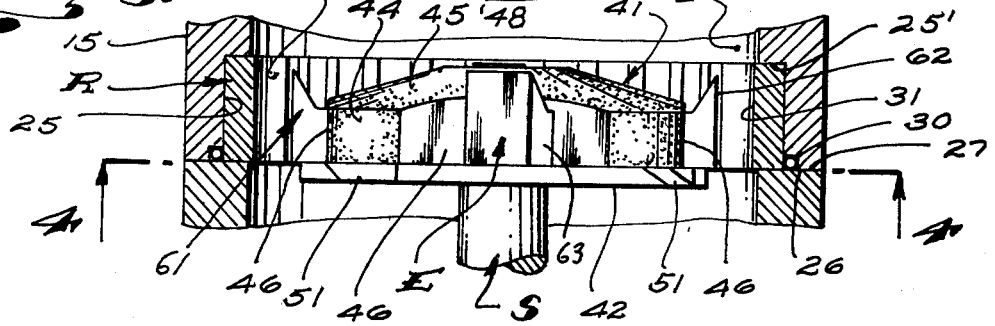
FIG. 3 is a sectional view taken as indicated by line 3—3 on FIG. 2.

In the case illustrated, the ring R is tightly engaged in and an annular radially inwardly opening recess 25 in the downstream or rear end 26 of the case section 15. The forward or upstream end of the ring is seated on the bottom shoulder 25' of the recess 25 and is held captive within the recess and tight against said shoulder by the forward or upstream end of the case section 16, as clearly illustrated in FIG. 3 of the drawings.

In practice, and as shown in FIG. 4 of the drawings, the clearance between the parts is such that upon tightening of the coupling means $C^2$, the case sections 15 and 16 are drawn together and into engagement with the ring R so as to establish tight clamped engagement therewith and to thereby prevent misalignment, displacement or relative rotation of the ring relative to the case.

The ring R fully occupies the annular recess 25 and preferably projects radially inwardly from the recess and into the passage P a slight or limited extent.

The ring R is provided with or has a plurality of circumferentially spaced, elongate, axially extending radially inwardly projecting milling teeth T formed therein. The teeth T have axially and circumferentially extending radially inwardly disposed inner ends or faces 31 and axially and radially extending circumferentially oppositely disposed flanks or sides 32. The faces 31 and sides 32 converge to define sharp, axially extending cutting edges 33 along the axially extending opposite inner edges of the teeth.

The teeth are of such radial extent and are spaced circumferentially, one from the other, to define axially and radially inwardly opening material conducting flow passages F of predetermined, desired cross-sectional extent.

The cross-sectional extent of the passages F is substantially equal to the cross-sectional extent of the largest size of particle the mill is designed to pass or permit passage of.

The diametric extent of the ring and the number of passages F afforded thereby is such that the accumulated cross-sectional area of all the passages F is sufficiently greater than the cross-sectional area of the passage P through the case so that substantially unchoked or free, unobstructed flow of material can be normally maintained through the mill M.

The mill M that I provide next includes a substantially flat radially extending disc-shaped rotor A. The rotor A is less in axial extent than the ring R and is drivingly mounted on and carried by the inner or forward end of the drive shaft S of the motor P' to occur within the rear or downstream end portion of the ring R.

The rotor A is sufficiently less in diametric extent than the circular line on which the faces 30 of the teeth occur so that free running clearance between the rotor A and the teeth T is assured.

It is to be noted that the rotor A overlies and substantially closes the downstream or rear end portions of the inner sides of the passages F whereby material flowing through the mill is caused to move into and through the passages F, yet leaves the upstream or forward portions of the inner sides of the passages F open, whereby material, upstream of the rotor, and radially inward of the ring, can move freely and/or be urged circumferentially and radially outward into engagement with the teeth and into the passages F throughout the forward or upstream portion of the ring R.

The rotor A is a two-part assembly comprising a body 41 and a retaining plate 42. The body 41 is a heavy durable part cast or forged of steel or the like. The body 41 has a flat radially extending rear end surface 43 disposed rearwardly or downstream in the construction, a substantially circular or cylindrical side wall or edge 44 and an axially forwardly and radially inwardly convergent, truncated, forward or upstream end surface 45. The body 41 is relieved at four sides by radially outwardly disposed flats 46 extending on cord lines spaced 90° about the circumference of the body. The body has a central threaded shaft receiving opening 47 in which the forward portion of the shaft S is cooperatively engaged. The body 41 is next characterized by and includes four straight elongate circumferentially spaced rearwardly opening milling block receiving channels 48 entering its rear surface 43 and extending across that surface with at least one of their ends opening radially outward at points intermediate the ends of related relief or flat 46, at the outside of the body.

The axes of the channels 48 might extend radially from the central axis of the rotor. In such a case, the longitudinal extent of the channels would be limited to a length which is less than the radial extent of the rotor.

In the preferred carrying out of the invention, the axes of the channels are angularly related to the radial plane of the body to extend along cord lines which are spaced radially outward from the central axis of the rotor where they are tangent with said axis of the rotor and so that the longitudinal extent of the channels can be and is materially greater than the radial extent of the rotor.

The longitudinal extent of the channels determines the length that the milling blocks can be. As the length of the channels and milling blocks is increased, the weight or mass of the blocks and the guided stability of the blocks increases proportionately.

The axes of the channels are, for example, disposed at about 30° from the radial planes of the rotor that intersect their outer open ends. The axes of the channels are on cord lines through the rotor so that their outer open ends are angularly disposed in or toward the normal direction of rotation of the rotor.

The rearwardly opening channels are rectangular or square in cross-section with flat straight parallel sides and flat straight bottoms.

The inner end of each channel, that is, the end of each channel remote from its outer open end, preferably intersects with and opens at a side of its next adjacent or related channel as clearly illustrated in the drawings.

The retaining plate 42 is a flat, radially extending disc-shaped metal part corresponding in radial extent with the body 41 and is positioned adjacent the rear surface 43 of the body 41 to overlie and close the rear open sides of the channels and to cooperate therewith to define milling block guideways G.

The plate 42 is releasably secured to the body by screw fasteners 50, as shown in FIGS. 2 and 4 of the drawings.

The outer edge portion of the plate 42, adjacent the relieved portions or flats 46 of the body, project out from the relieved portions of the body and cooperate therewith to define four circumferentially spaced radially outwardly and axially forwardly opening material receiving recesses about the perimeter of the rotor, with which the outer ends of the channels or guideways G communicate.

The plate 42 has a central opening to accommodate the shaft S.

In the preferred carrying out of the invention and as shown in the drawings, the forward surface of the plate is on substantially the same radial plane as is the rear or downstream end of the ring R, and the plate is formed with a plurality (4) of circumferentially spaced radially outwardly projecting blades 51 which extend radially outwardly and across the rear open ends of the passages F and the rear ends of the teeth T of the ring R, in running clearance therewith.

The blades 51 are such that when the rotor is turned and materials advance from and out of the downstream ends of the passages F, the blades engage that material and, in cooperation with the teeth T, shear, cut or otherwise effectively reduce that material.

The provision of the blades 51 noted above is highly desirable since they affect the reduction of long fibrous material which might otherwise advance through the mill to collect about the shaft S and plug or otherwise foul the construction.

In furtherance of my invention, the mill M next includes four elongate milling blocks E engaged in the guideways G in the rotor R. The blocks E have straight, elongate, inner shanks 60 which are similar in cross-section with and are slidably engaged in the guideways G. The blocks E next have enlarged milling heads 61 at their outer ends which heads occur within and normally project radially outward and axially forward from the material receiving recesses defined by the flats 46 and plate 41 of the rotor.

The milling heads 61 of the blocks have radially outwardly disposed outer end faces 62 substantially equal in circumferential extent with the distance between centers of adjacent teeth T on the ring R and substantially equal in axial extent with the axial extent of the teeth T.

The heads 61 have flat radially extending opposite sides 63 which converge with the end faces 62 to define sharp cutting edges 64 which cooperate with the edges 33 on the teeth to shear material engaged therebetween, and when the mill is in operation.

It is important to note that the enlarged heads 61 on the blocks E occur within the material receiving recesses about the perimeter of the rotor and project upstream or forward from the rotor where they are free to engage and forcibly move solids advanced through the mill, circumferentially and radially outwardly within and about the ring R, thus affording effective and efficient milling action.

My mill construction next includes stop means H to limit radial outward shifting of the milling blocks E relative to the rotor D and to normally maintain the outer faces 62 of the blocks in predetermined working clearance with the teeth T of the ring R.

The stop means H can vary in practice and is shown as including an elongate axially extending slot 66 with inner and outer ends, in the shank of each block and stop pins 67 carried by the rotor and extending through the slots and normally engaging the inner ends thereof, as clearly shown in the drawings. The stop pins 67 are defined by the shanks of screw fasteners 68 engaged through the rotor plate 42, through the slot 66 in the blocks and then into the rotor body 41.

The stop means H is such that it limits outward movement of the blocks relative to the rotor by centrifugal forces generated when the rotor is rotated. The means H is such that the blocks are substantially free to be urged and moved inwardly relative to the rotor and away from the ring by the interfering material whereby the block can move or ride over the interfering material. The above function avoids stopping and jamming of the rotor and allows or permits the next advancing block or blocks to advance and strike or engage the interfering material.

The capacity of the instant invention to allow or permit the blocks to move by interfering material which is not reduced by them and to allow for such material to be struck or engaged repeatedly by the advancing blocks is highly important, since in most instances, material which is not reduced by the forces applied by the first block to engage it will reduce under the force or forces of the second or third block to engage it.

It is to be noted that when a block is caused to move in and ride over a piece of material stopped on a tooth T of the rings R, the advancing or moving outer surface 62 of the block tends to and in most instances drag and/or turns the piece of material in such a way that it is free to move and advance through the mill or so repositions the material that it is readily reduced by the force and action of the next block advanced into engagement with it.

The above noted angular disposition of the guideways G and the resulting angular disposition of the blocks E is such that the leading cutting edges 64 on the heads of the blocks, defined by the convergence of surfaces at acute angle with each other, are sharp efficient cutting edges. Further, the angular disposition of the guideways G and the blocks E is such that the axes of the blocks are inclined about 30° from normal (radial) in the direction of normal rotation and about 60° from the direction of forces imparted onto the outer ends of the heads of the blocks by materials stopped by the teeth T of the ring and engaged by the advancing blocks.

As a result of the above relationship of parts, the blocks are more easily moved inwardly; the tendency for the blocks to bind and lock up in the guideways G is minimal; and the forces imposed upon and through the blocks and the rotor are materially less than would be the case if the axes of the passageways and the blocks were arranged radially of the rotor.

It is to be noted that the length of the shanks of the blocks must be such that adequate working clearances are provided between the inner ends of the blocks and the inner ends of the guideways to permit the blocks to move inwardly as desired.

It is also to be noted that adequate working clearances must be provided between the radially inwardly disposed surfaces on the forward portions of the heads of the blocks and the flats 46 on the rotor body to allow for desired inward shifting of the blocks.

In the preferred carrying out of my invention, the radially inwardly disposed inner faces of the forwardly projecting portions of the heads on the blocks E are inclined axially forwardly and radially outwardly relative to the axis of the rotor to substantially converge with the outer faces of the heads and to define forwardly disposed corners and edges on the head that are sufficiently sharp and thin to effectively cut and otherwise reduce solid materials engaged thereby and so that the heads are relieved to occupy a minimum amount of space in the material receiving recesses defined by the flats 46 on the body 41 and the plate 42 of the rotor.

The prime mover or motor P′ is preferably a reversible motor and has suitable electrical components related to it to cause it to reverse its direction of rotation for a limited predetermined period of time, when and if it is stopped from rotating in its normal clockwise direction by externally applied forces. For example, the motor P′ is such that if the motor is stopped by a piece of interfering material lodged or wedged between a tooth T and a block E, the motor commences to rotate and is driven in a reverse or counter-clockwise direction for a period of time sufficient for the interfered with block to disengage the material and for other blocks on the rotor to engage and move the material from interfering engagement with the interfered with tooth T. Thereafter, the motor reverses to again turn in its normal clockwise direction of rotation.

Upon reverse rotation of the rotor, the blocks engage interfering material within the ring and most often move that material from interfering disposition within the ring or reduce such material in substantially the same manner that material is reduced by the construction when operating in its normal clockwise direction of rotation.

It will be apparent that when the rotor rotates counter-clockwise or in reverse, the advancing sides 32 of the heads of the blocks are pitched or inclined radially inwardly and counter to the direction of rotation at, for example, 30° from normal and such that if and when they engage interfering material stopped on teeth within the ring, they can cam or ride over that material and work on it in, a manner as to move it from interfering disposition within the construction or so redispose it that it is readily reduced by the milling action afforded by the construction.

In practice, the reversible motor P and the control circuit therefor can vary widely without affecting or departing from the spirit of the present invention.

Figure 6:
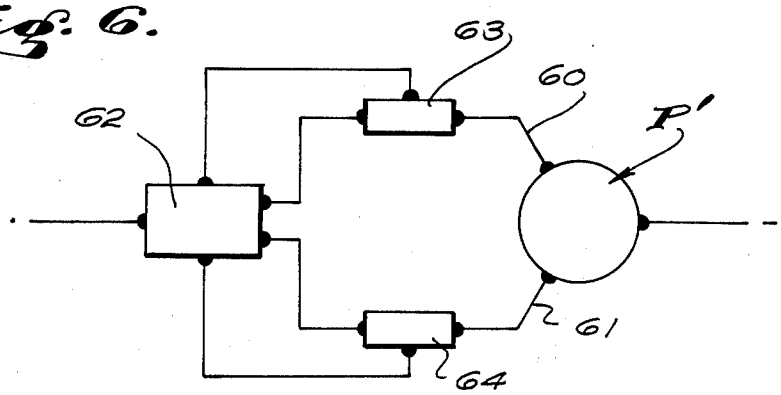
FIG. 6 is a circuit diagram for the prime mover.

FIG. 6 of the drawings is a diagrammatic view of a circuit for the motor P'.

The motor P' is shown as having a pair of power supply lines 60 and 61 for selectively directing current to one of two fields within the motor (not shown). The lines 60 and 61 are connected with a two-position relay switching unit 62, which unit is connected with a power source. The unit 62 is normally closed with the line 60. The relay of the unit 62 is under control of an overload device 63 in the line 60. When the motor is stopped by externally applied forces, the device 62 senses the change in the load on line 60 and transmits an operating current to the relay unit which causes the unit to open the circuit line 60 and to close the circuit to line 61, thereby energizing and causing the motor to drive and rotate in a reverse or counter-clockwise direction.

A timing device 64 is engaged in the line 61. The device 64 is connected with the unit 62 and is such that after the motor is operated in reverse for a limited predetermined period of time, the unit 62 is operated to open the circuit to line 61 and to close the circuit to line 60, thereby causing the motor to again rotate in its normal, clockwise direction of rotation.

Having described only one typical form and embodiment of my invention, I do not wish to be limited to the specific details herein set forth but wish to reserve to myself my modifications and/or variations that may appear to those skilled in the art and which fall within the scope of the following claims:

Having described my invention, I claim:

1. A mill comprising an elongate case with front and rear ends and a central longitudinal flow passage, coupling means coupling the front and rear ends of the case with upstream and downstream fluid conducting means, an elongate annular milling ring with front and rear ends arranged within the case between the ends thereof concentric with the flow passage therein and having a plurality of elongate axially extending circumferentially spaced inwardly projecting teeth projecting radially inward into the passage, adjacent teeth on the ring defining axially extending radially inwardly and axially opening material conducting passages, an elongate substantially disc-shaped rotor less in axial extent than the ring arranged concentric within the rear portion of the ring in free running clearance therewith, said rotor has a plurality of circumferentially spaced, elongate, straight guideways the axes of which occur on radial planes through the rotor, each guideway has an outer end opening substantially radially at the perimeter of the rotor, a plurality of milling blocks with elongate shanks having inner and outer ends and outer work-engaging heads on the outer ends of the shanks, the shank of each block is slidably engaged in a guideway with its head outside the guideways and projecting substantially radially outwardly from the rotor toward said ring, said heads have radially outwardly disposed end faces corresponding substantially in axial extent with said teeth and have substantially axially extending circumferentially disposed opposite sides converging with said faces and defining circumferentially spaced substantially axially extending cutting edges, stop means carried by the rotor and engaging the shanks of the blocks and limiting radial outward shifting of the blocks to positions where the outer faces and cutting edges are in close running clearance with the teeth and permitting free inward shifting of the blocks relative to the teeth, a shaft extending axially and concentric within the passage and drivingly supporting the rotor within the case and the ring, and a prime mover at the exterior of the case coupled with the shaft.

2. The mill set forth in claim 1 wherein the rotor has circumferentially spaced radially outwardly disposed flats about its perimeter defining material receiving recesses about the rotor and within which the heads of the blocks are freely positioned and into which the outer ends of the shanks of the blocks normally project.

3. The mill set forth in claim 2 wherein the guideways are greater in longitudinal extent than the radius of the rotor and are disposed with their axes on cord lines spaced radially outward from the axis of the rotor, said shanks of the blocks are greater in longitudinal extent than the radius of the rotor and less in longitudinal extent than the guideways.

4. The mill set forth in claim 3 wherein one end portion of the case turns radially outward relative to the axis of the case on which the shaft occurs, said shaft has one end portion of the case, said prime mover is mounted at the exterior of the case and has a drive shaft joined with said shaft.

5. The mill set forth in claim 3 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

6. The mill set forth in claim 2 wherein one end portion of the case turns radially outward relative to the axis of the case on which the shaft occurs, said shaft has one end portion extending through and outward from said one end portion of the case, said prime mover is mounted at the exterior of the case and has a drive shaft aligned and coupled with said shaft.

7. The mill set forth in claim 6 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

8. The mill set forth in claim 2 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

9. The mill set forth in claim 1 wherein the guideways are greater in longitudinal extent than the radius of the rotor and are disposed with their axes on cord lines spaced radially outward from the axis of the rotor, said shanks of the blocks are greater in longitudinal extent than the radius of the rotor and less in longitudinal extent than the guideways.

10. The mill set forth in claim 9 wherein one end portion of the case turns radially outward relative to the axis of the case on which the shaft occurs, said shaft has one end portion extending through and outward from said one end portion of the case, said prime mover is mounted at the exterior of the case and has a drive shaft joined with said shaft.

11. The mill set forth in claim 10 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

12. The mill set forth in claim 9 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

13. The mill set forth in claim 1 wherein one end portion of the case turns radially outward relative to the axis of the case on which the shaft occurs, said shaft has one end portion extending through and outward from said one end portion of the case, said prime mover is mounted at the exterior of the case and has a drive shaft joined with said shaft.

14. The mill set forth in claim 3 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

15. The mill set forth in claim 1 wherein said rotor has a plurality of circumferentially spaced radially outwardly projecting cutting blades on a plane adjacent the plane of the rear end of the ring, said blades are movable circumferentially relative to and in material shearing relationship with the rear ends of the teeth.

16. The mill set forth in claim 1 wherein said stop means includes an elongate slot with inner and outer ends in and extending longitudinally of the shank of each block and stop pins carried by the rotor and projecting into said slots and normally engaging the inner ends of the slots.

* * * * *